US009969063B2

(12) United States Patent
Liu

(10) Patent No.: US 9,969,063 B2
(45) Date of Patent: May 15, 2018

(54) RATCHET WRENCH

(71) Applicant: Yi-Yong Liu, Taichung (TW)

(72) Inventor: Yi-Yong Liu, Taichung (TW)

( * ) Notice: Subject to any disclaimer, the term of this patent is extended or adjusted under 35 U.S.C. 154(b) by 323 days.

(21) Appl. No.: 15/008,395

(22) Filed: Jan. 27, 2016

(65) Prior Publication Data

US 2017/0209988 A1 Jul. 27, 2017

(51) Int. Cl.
*B25B 13/46* (2006.01)

(52) U.S. Cl.
CPC ..... *B25B 13/463* (2013.01)

(58) Field of Classification Search
CPC ..... B25B 13/46; B25B 13/461; B25B 13/463
See application file for complete search history.

(56) References Cited

U.S. PATENT DOCUMENTS 5,875,693 A * 3/1999 Zurbuchen ..... B25B 13/461 81/177.1
6,318,216 B1 * 11/2001 Eggert ..... B25B 13/04 81/124.3
6,978,700 B2 * 12/2005 Chen ..... B25B 13/462 192/43
8,109,180 B2 * 2/2012 Hu ..... B25B 13/463 81/60
8,141,460 B2 * 3/2012 Hobden ..... B25B 13/465 81/124.5
8,312,794 B2 * 11/2012 Hobden ..... B25B 13/465 81/124.5
8,806,986 B2 * 8/2014 Chen ..... B25B 1/02 81/62
9,089,953 B2 * 7/2015 Heidel ..... B25B 13/465
2002/0011136 A1 * 1/2002 Eggert ..... B25B 13/04 81/125.1
2012/0272793 A1 * 11/2012 Lin ..... B25B 13/463 81/63
2013/0233132 A1 * 9/2013 Chen ..... B25B 13/463 81/60

* cited by examiner

*Primary Examiner* — David B Thomas

(57) ABSTRACT

A ratchet wrench includes a first body made of light material and has a first recess, a closed bottom, a first hole, a first groove, a second recess and a shoulder formed between the first and second recesses. A second body made of strong material and has a first portion and a second portion so as to be respectively received in the first and second recesses. The first portion is rested on the shoulder. A ratchet wheel and a pawl respectively received in the second body, and a switch unit is connected to the second body to operate the pawl to be engaged with the ratchet wheel. The ratchet wrench has simple structure and easily assembled and manufactured. The ratchet wrench is light and durable.

10 Claims, 8 Drawing Sheets

B-B

C-C

RATCHET WRENCH

BACKGROUND OF THE INVENTION

1. Fields of the Invention

The present invention relates to a ratchet wrench, and more particularly, to a ratchet wrench with light weight and reliable structure.

2. Descriptions of Related Art

One of the conventional ratchet wrenches is disclosed in U.S. Pat. No. 4,991,468 and comprises a body with a first recess and a second recess. A ratchet wheel is located in the first recess and has a toothed portion defined in the outside thereof. A bottom cover is connected to the underside of the body. A pawl is received in the second recess and has engaging teeth which are engaged with the toothed portion of the ratchet wheel. A top cover is connected to the top of the body. However, the body is made by steel which is heavy so that the user has to operate by a significant force and the heavy tool may hurt the user's wrist. Another one of the conventional ratchet wrenches is disclosed in U.S. Pat. No. 3,742,788 and which has similar drawbacks as the U.S. Pat. No. 4,991,468.

The present invention intends to provide a ratchet wrench which improves the shortcomings mentioned above.

SUMMARY OF THE INVENTION

The present invention relates to a ratchet wrench and comprises a body made of light material and has a first recess which has a closed bottom. The first recess has a first side, a second side and a third side, wherein the first and third sides each are a curved side, and the second side is a straight side. The second side is tangent to the first and third sides. A first hole is defined through the closed bottom and shares a common axis with the first side. The diameter of the first side is larger than that of the first hole. A first groove is defined in the inner periphery of the first hole. A second recess is defined in the body and located above the first recess, and is larger than the first recess. A shoulder is formed between the first and second recesses. The second recess is offset from the first recess. The first, second and third sides are located between the closed bottom and the shoulder.

A second body is made of strong material and has a first portion and a second portion, wherein the first portion is smaller than the second portion. The first portion is received in the first recess and contacts the closed bottom. The second portion is received in the second recess and contacts the shoulder. The second body has a first room, a second room and a third room. The first room, the second room and the third room communicate with each other. The first room is a round through hole. The first room shares a common axis with the first hole. The first room and the first hole have the same diameter. The second room is defined in the inner periphery of the first room. The center of the second room is located within the first room. The diameter of the second room is smaller than that of the first room. The second room has a closed top. The second room has a fourth side. The second side faces the second room which is located between the first and third rooms. The third room is a round hole, and the diameter of the third room is smaller than that of the second room. The third room shares a common axis with the third side. An end face is formed around the top of the second portion.

A ratchet wheel is pivotably located in the first hole and the first room. The ratchet wheel has a toothed portion defined in the outer periphery thereof. The ratchet wheel has an engaging recess defined in the center thereof. A disk is connected to the top of the ratchet wheel. The periphery of the disk protrudes outward radially from the top of the ratchet wheel. The disk contacts the end face of the second body. The ratchet wheel has a second groove which is located corresponding to the first groove.

A pawl is located in the second room of the second body and is movable within the second room. The top of the pawl is restricted by the fourth side of the second body. The bottom of the pawl is restricted by the closed bottom of the first body. The pawl has engaging teeth defined in the front side thereof, and the engaging teeth are engaged with the toothed portion of the ratchet wheel.

A switch unit is pivotably connected to the third room of the second body and controls movement of the pawl in the second room. The switch unit has a switch member, a cap and a spring. The switch member is pivotably connected to the third room. An underside of the switch member contacts the closed bottom of the first body. A lever is connected to the top of the switch member and exposed beyond the second body. The lever contacts the end face. The switch unit has a reception recess which faces the pawl. The cap and the spring are located in the reception recess. The cap is biased by the spring to contact the rear side of the pawl so as to push the pawl to engage the engaging teeth with the toothed portion of the ratchet wheel. The cap contacts the fourth side of the second body to prevent the switch unit from disengaging from the third room.

A clip is engaged with the first and second grooves to restrict the ratchet wheel within the first hole and the first room. The disk contacts the end face to connect the second body to the first body.

The primary object of the present invention is to provide a ratchet wrench which is light in weight and durable for use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
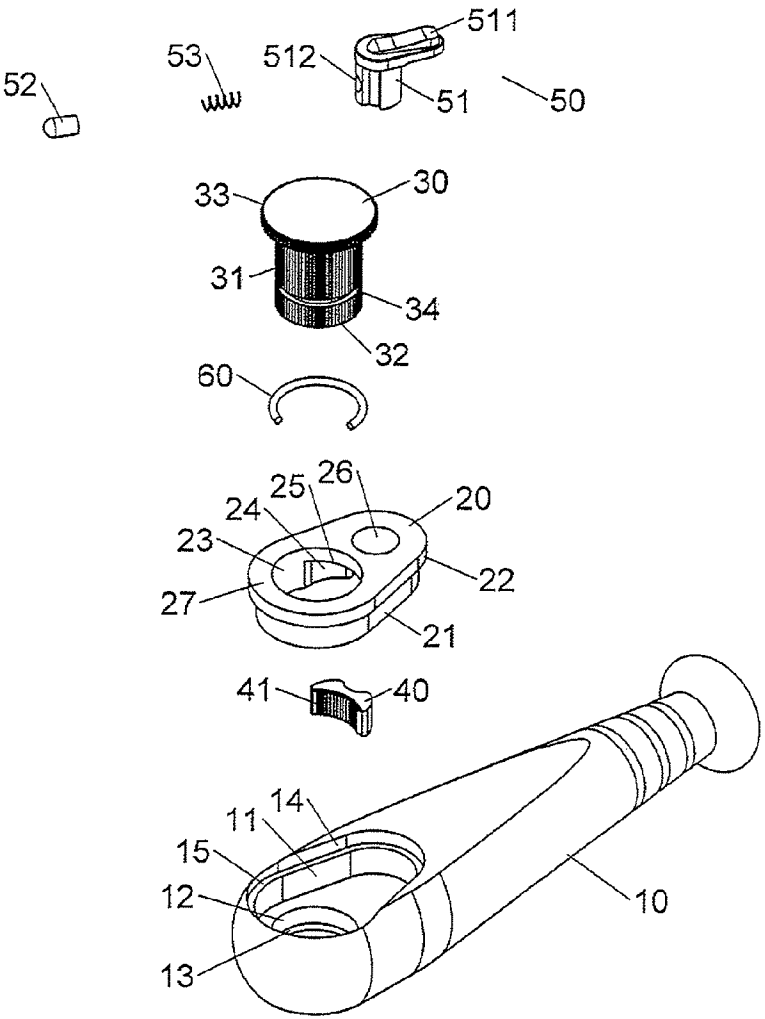
FIG. 1 is an exploded view of the ratchet wrench of the present invention.
Figure 2:
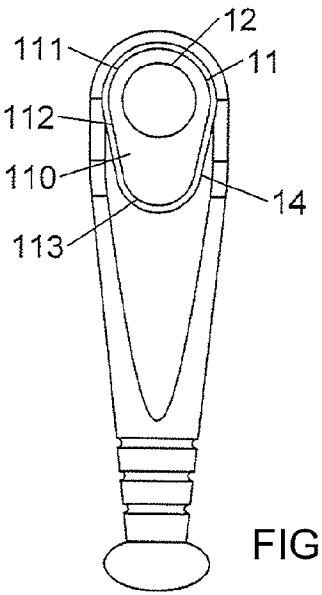
FIG. 2 is a top view of the first body of the ratchet wrench of the present invention.
Figure 3:
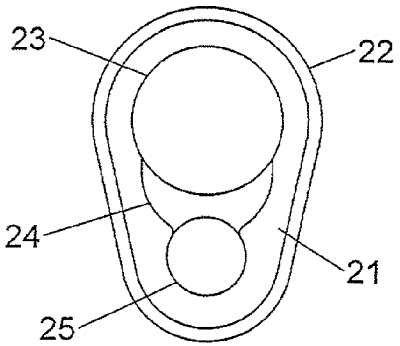
FIG. 3 is a top view of the second body of the ratchet wrench of the present invention.

Referring to FIGS. 1 to 3, the ratchet wrench of the present invention comprises a first body 10 made of light material, such as Aluminum, Magnesium, alloy, plastic or carbon fibers. The first body 10 has a first recess 11 which has a closed bottom 110. The first recess 11 has a first side 111, a second side 112 and a third side 113, wherein the first and third sides 111, 113 each are a curved side, and the second side 112 is a straight side. The second side 112 is tangent to the first and third sides 111, 113. A first hole 12 is defined through the closed bottom 110 and shares a common axis with the first side 111. The diameter of the first side 111 is larger than that of the first hole 12. A first groove 13 is defined in the inner periphery of the first hole 12. A second recess 14 is defined in the body 10 and located above the first recess 11, and is larger than the first recess 11. A shoulder 15 is formed between the first and second recesses 11, 14. The second recess 14 is offset from the first recess 11. The first, second and third sides 111, 112, 113 are located between the closed bottom 110 and the shoulder 15.

A second body 20 is made of strong material such as steel, iron or alloy. The second body 20 has a first portion 21 and a second portion 22, wherein the first portion 21 is smaller than the second portion 22. The first portion 21 is received in the first recess 11 and contacts the closed bottom 110. The second portion 22 is received in the second recess 14 and contacts the shoulder 15. The second body 20 has a first room 23, a second room 24 and a third room 26. The first room 23, the second room 24 and the third room 26 communicate with each other. The first room 23 is a round through hole. The first room 23 shares a common axis with the first hole 12. The first room 23 and the first hole 12 have the same diameter. The second room 24 is defined in the inner periphery of the first room 23. The center of the second room 24 is located within the first room 23. The diameter of the second room 24 is smaller than that of the first room 23. The second room 24 has a closed top. The second room 24 has a fourth side 25. The second side 112 faces the second room 24 which is located between the first and third rooms 23, 26. The third room 26 is a round hole, and the diameter of the third room 26 is smaller than that of the second room 24. The third room 26 shares a common axis with the third side 113. An end face 27 is formed around the top of the second portion 22.

A ratchet wheel 30 is pivotably located in the first hole 12 and the first room 23. The ratchet wheel 30 has a toothed portion 31 defined in the outer periphery thereof. The ratchet wheel 30 has an engaging recess 32 defined in the center thereof. The engaging recess 32 is a polygonal recess and is a recess with a closed end so as to be directly connected with a socket or other parts. A disk 33 is connected to the top of the ratchet wheel 30. The periphery of the disk 33 protrudes outward radially from the top of the ratchet wheel 30. The disk 33 contacts the end face 27 of the second body 20. The ratchet wheel 30 has a second groove 34 which is located corresponding to the first groove 13.

A pawl 40 is located in the second room 24 of the second body 20 and is movable within the second room 24. The top of the pawl 40 is restricted by the fourth side 25 of the second body 20. The bottom of the pawl 40 is restricted by the closed bottom 110 of the first body 10. The pawl 40 has engaging teeth 41 defined in the front side thereof, and the engaging teeth 41 are engaged with the toothed portion 31 of the ratchet wheel 30.

A switch unit 50 is pivotably connected to the third room 26 of the second body 20 and controls movement of the pawl 40 in the second room 24. The switch unit 50 has a switch member 51, a cap 52 and a spring 53. The switch member 51 is pivotably connected to the third room 26. An underside of the switch member 51 contacts the closed bottom 110 of the first body 10. A lever 511 is connected to the top of the switch member 51 and exposed beyond the second body 20. The lever 511 contacts the end face 27. The switch unit 50 has a reception recess 512 which faces the pawl 40. The cap 52 and the spring 53 are located in the reception recess 512. The cap 52 is biased by the spring 53 to contact the rear side of the pawl 40 so as to push the pawl 40 to engage the engaging teeth 41 with the toothed portion 31 of the ratchet wheel 30. The cap 52 contacts the fourth side 25 of the second body 20 to prevent the switch unit 50 from disengaging from the third room 26.

A clip 60 is engaged with the first and second grooves 13, 34 to restrict the ratchet wheel 30 within the first hole 12 and the first room 23. The disk 33 contacts the end face 27 to connect the second body 20 to the first body 10.

Figure 4:
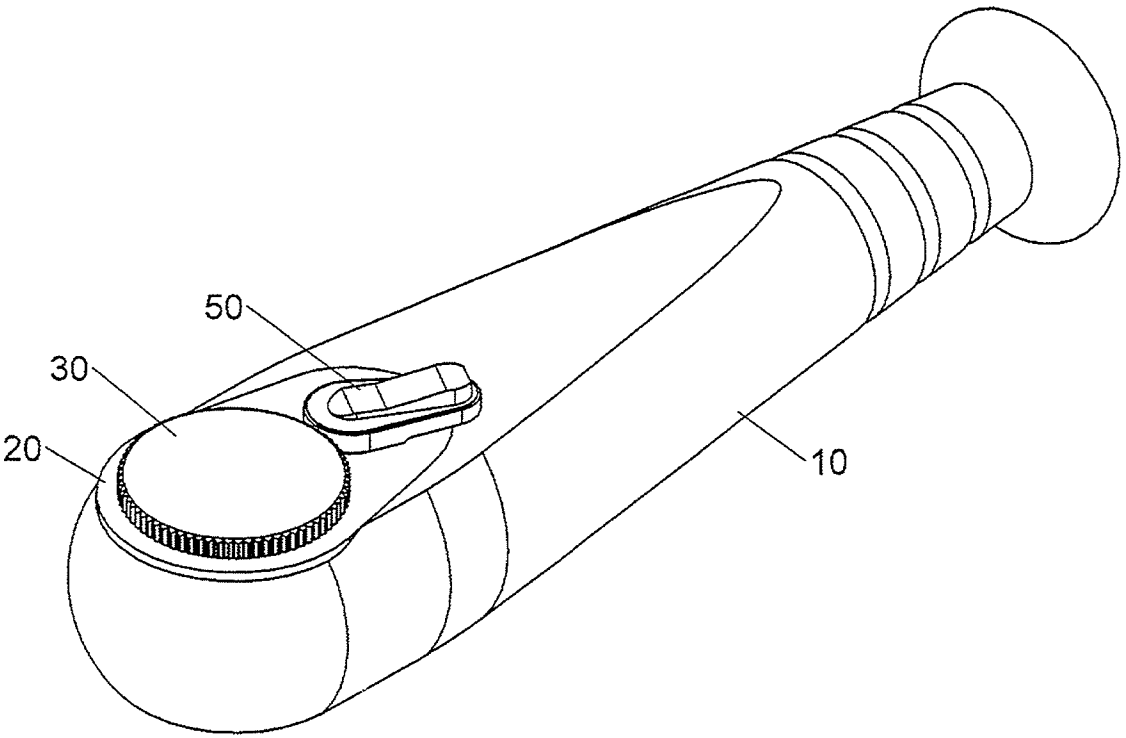
FIG. 4 is a perspective view of the ratchet wrench of the present invention.

As shown in FIG. 4, the first room 23 shares a common axis with the first hole 12, and the first room 23 and the first hole 12 have the same diameter. The toothed portion 31 of the ratchet wheel 30 is located in the first hole 12 and the first room 23. The disk 33 and the lever 511 both contact the end face 27 of the second body 20.

Figure 5:
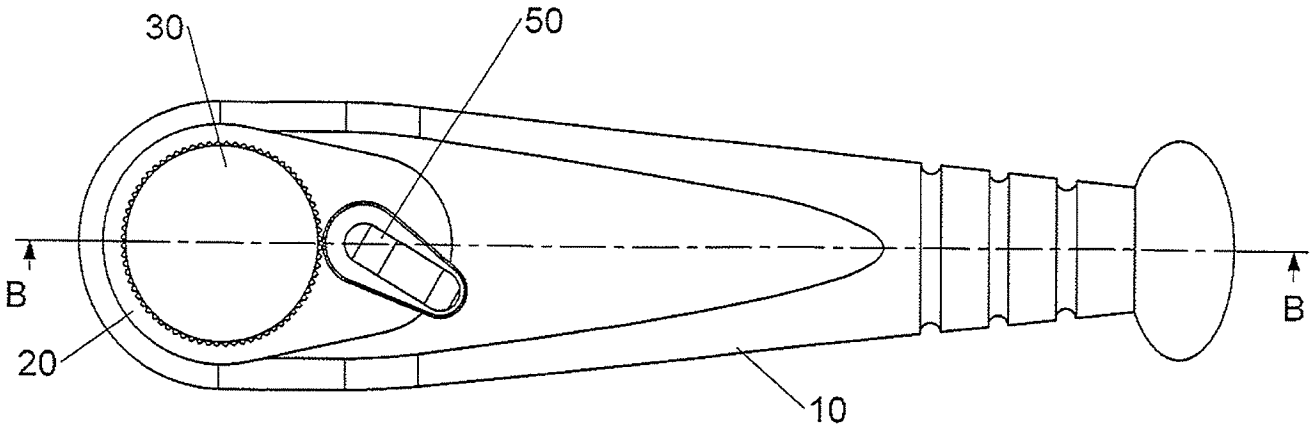
FIG. 5 is a top view of the ratchet wrench of the present invention.
Figure 6:
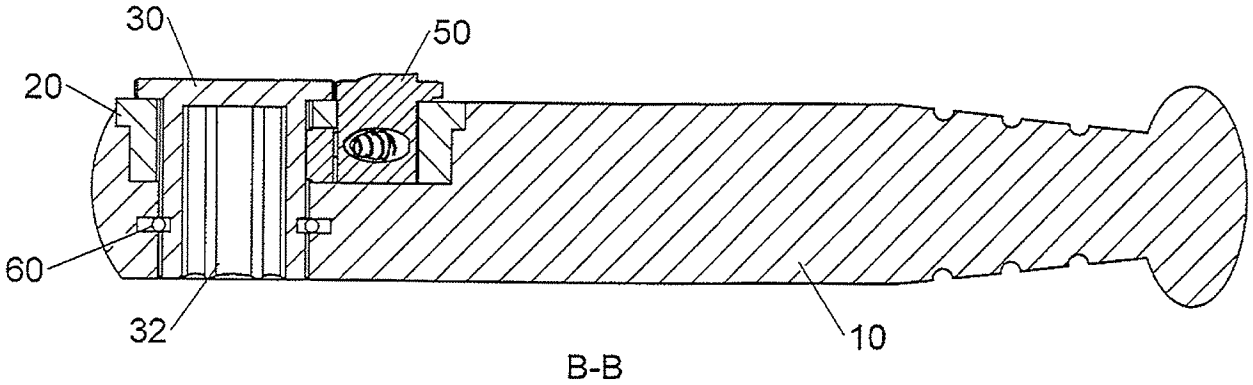
FIG. 6 is a cross sectional view, taken along line B-B in FIG. 5.

As shown in FIGS. 5 and 6, the first portion 21 of the second body 20 is received in the first recess 11 of the first body 10, and the first portion 21 is in contact with the closed bottom 110. The second portion 22 is received in the second recess 14 and contacts the shoulder 15. The lower end of the switch member 51 contacts the closed bottom 110 of the first body 10, and the lever 511 contacts the end face 27 of the second body 20. The clip 60 is engaged with the first and second grooves 13, 34 to pivotably connect the ratchet wheel 30 to the first hole 12 of the first body 10 and the first room 23 of the second body 20. The disk 33 contacts the end face 27 of the second body 20 to connect the second body 20 to the first body 10.

Figure 7:
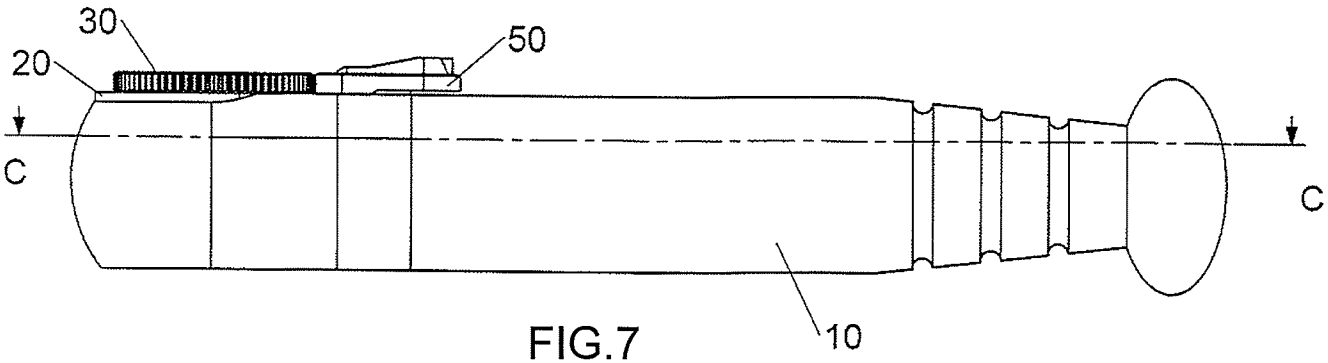
FIG. 7 is a side view of the ratchet wrench of the present invention.
Figure 8:
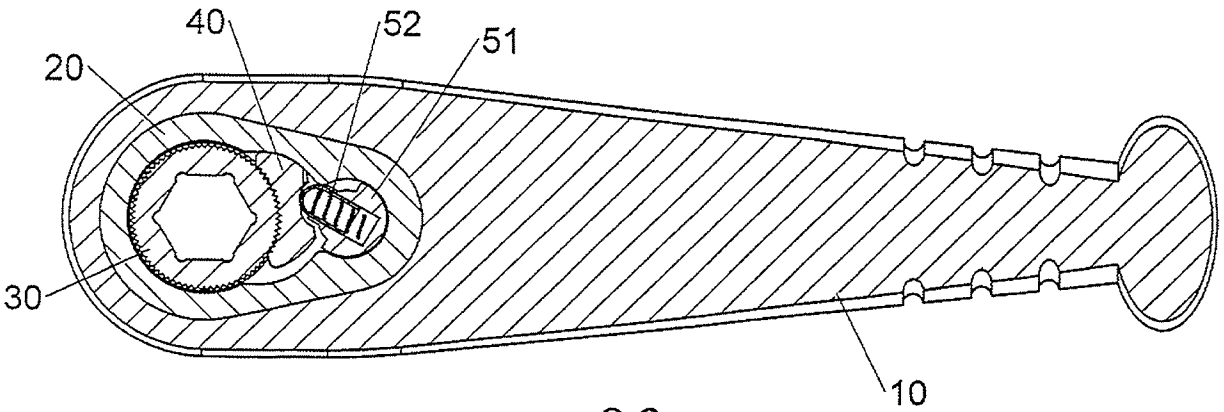
FIG. 8 is a cross sectional view, taken along line C-C in FIG. 7.

As shown in FIGS. 7 and 8, the switch unit 50 is pivotably connected to the third room 26 of the second body 20. The switch unit 50 is operated to control the movement of the pawl 40 in the second room 24. The pawl 40 is moved left and right to control the ratchet wrench to rotate clockwise and counter clockwise. The cap 52 and the spring 53 are located in the reception recess 512. The cap 52 is biased by the spring 53 to contact the rear side of the pawl 40 so as to push the pawl 40 to engage the engaging teeth 41 with the toothed portion 31 of the ratchet wheel 30. The engaging recess 32 is a polygonal recess and is a recess with a closed end so as to be directly connected with a socket or other parts.

Figure 9:
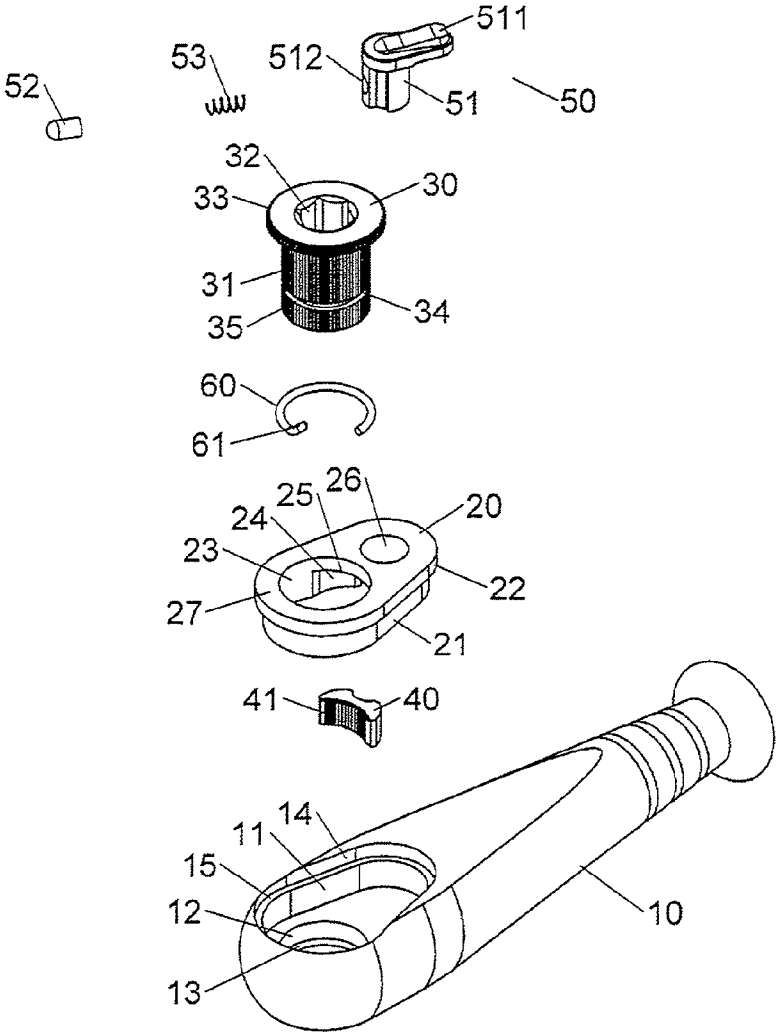
FIG. 9 is a perspective view of the second embodiment of the ratchet wrench of the present invention.

As shown in FIG. 9, the engaging recess 32 is a passage defined through the ratchet wheel 30, and the passage 35 communicates with the second groove 34 and the engaging recess 32. The clip 60 has a contact end 61 which is located in the passage 35 and protrudes into the engaging recess 32.

Figure 10:
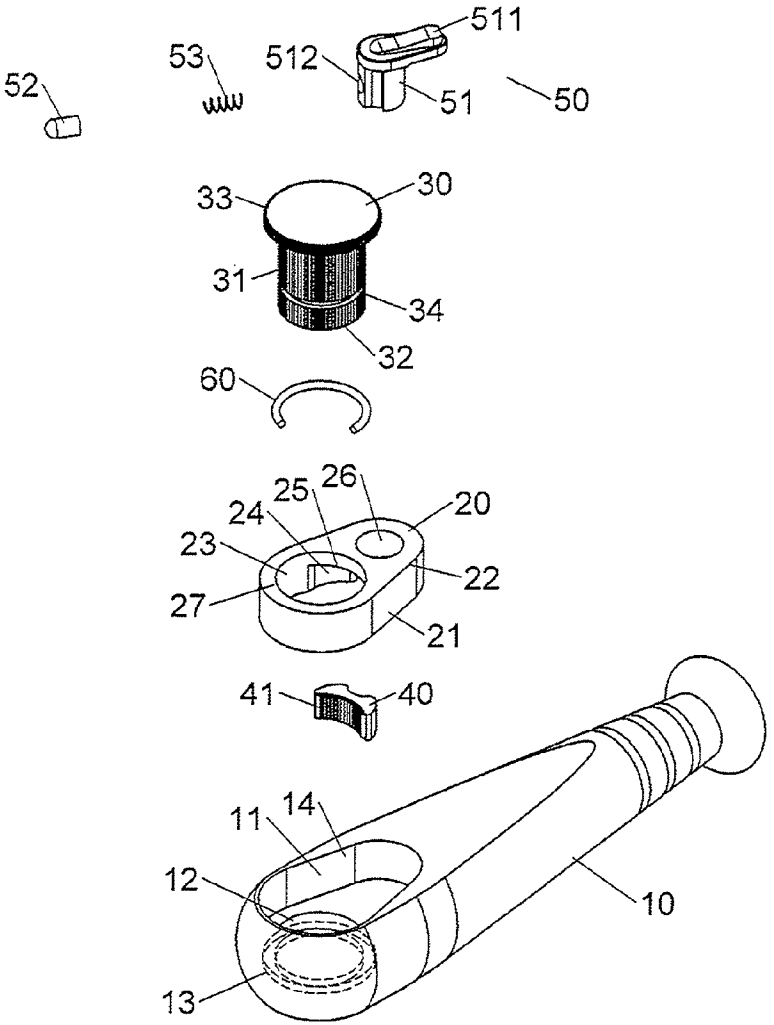
FIG. 10 is a perspective view of the third embodiment of the ratchet wrench of the present invention.

As shown in FIG. 10, the first recess 11 and the second recess 14 of the first body 10 have the same shape and size, and no shoulder is formed. The first and second portions 21, 22 have the same shape and size.

Figure 11:
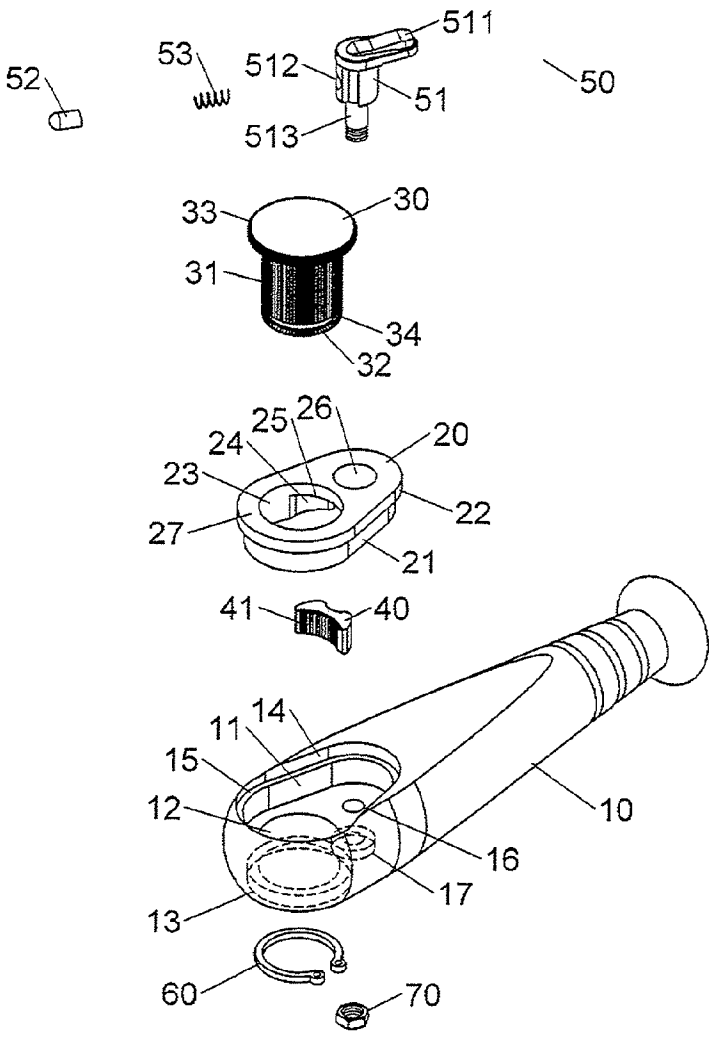
FIG. 11 is a perspective view of the fourth embodiment of the ratchet wrench of the present invention.
Figure 12:
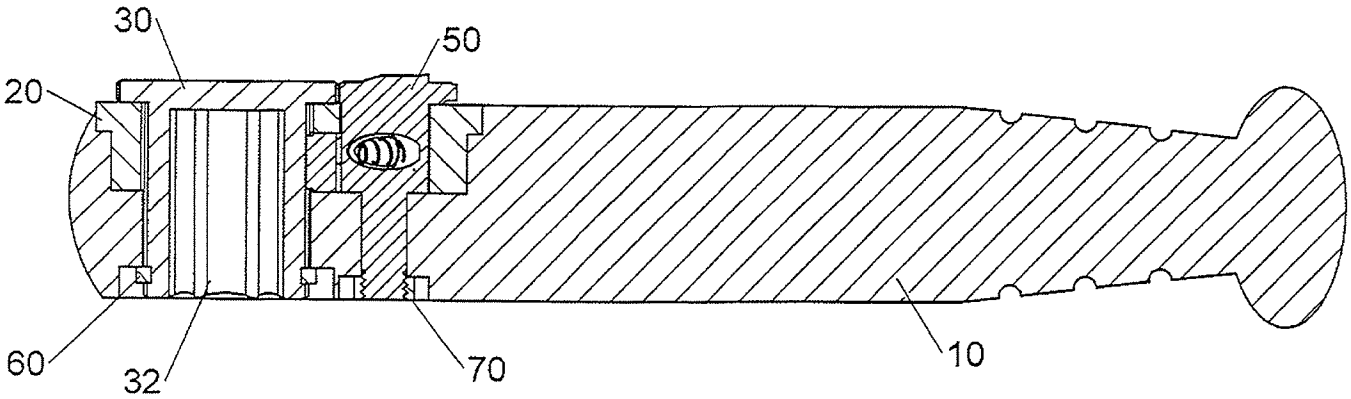
FIG. 12 is a side view of the fourth embodiment of the ratchet wrench of the present invention.

As shown in FIGS. 11 and 12, the first body 10 has a connection recess 16 and a threaded recess 17. The connection recess 16 is defined through the first body 10 and shares a common axis with the third room 26. The first groove 13 is located at the lower portion of the first hole 12. The second groove 34 is located at the lower portion of the toothed portion 31 of the ratchet wheel 30. The clip 60 protrudes beyond the first body 10 so as to be easily assembled and dis-assembled. The threaded recess 17 is located at the lower end of the connection recess 16. The switch member 51 has an insertion 513 which is pivotably connected to the connection recess 16. The distal end of the insertion 513 is threadedly connected to the threaded recess 17. A nut 70 is connected to the distal end of the insertion 513. The switch unit 50 is pivotably connected to the third room 26 of the second body 20.

Yet another embodiment of the present invention is that the engaging recess 32 is a rectangular head so as to be connected with a socket, a connector or a universal joint.

The first body 10 is made of light material, such as Aluminum, Magnesium, alloy, plastic or carbon fibers, so that the first body is light in weight. The second body 20 is made of strong material such as steel, iron or alloy so that the second body 20 can bear large torque.

The clip 60 is engaged with the first and second grooves 13, 34 to restrict the ratchet wheel 30 within the first hole 12 and the first room 23. The disk 33 contacts the end face 27 to connect the second body 20 to the first body 10.

The cap 52 contacts the fourth side 25 of the second body 20 to prevent the switch unit 50 from disengaging from the third room 26, and When manufacturing the first and second bodies 10, 20, because the first, second and third sides 111, 112, 113, and the first hole 12, the first room 23, the second room 24 and the third room 26 each have an open side, so that they are manufactured by using drills without other complicated tools. This can reduce the manufacturing cost.

As shown in FIG. 11, the insertion 513 is threadedly connected to the nut 70, so that the switch unit 50 is securely connected to the wrench. The clip 60 can be easily removed and re-assembled, so that some parts can be easily replaced to expand the range of use of the ratchet wrench of the present invention.

While we have shown and described the embodiment in accordance with the present invention, it should be clear to those skilled in the art that further embodiments may be made without departing from the scope of the present invention.

What is claimed is:

1. A ratchet wrench comprising:

a body made of light material and having a first recess which has a closed bottom, the first recess having a first side, a second side and a third side, the first and third sides each being a curved side, the second side being a straight side, the second side being tangent to the first and third sides, a first hole defined through the closed bottom and sharing a common axis with the first side, a diameter of the first side being larger than that of the first hole, a first groove defined in an inner periphery of the first hole, a second recess defined in the body and located above the first recess and being larger than the first recess, a shoulder formed between the first and second recesses, the second recess being offset from the first recess, the first, second and third sides located between the closed bottom and the shoulder;

a second body made of strong material and having a first portion and a second portion, the first portion being smaller than the second portion, the first portion received in the first recess and contacting the closed bottom, the second portion received in the second recess and contacting the shoulder, the second body having a first room, a second room and a third room, the first room, the second room and the third room communicating with each other, the first room being a round through hole, the first room sharing a common axis with the first hole, the first room and the first hole have the same diameter, the second room defined in an inner periphery of the first room, a center of the second room located within the first room, a diameter of the second room being smaller than that of the first room, the second room having a closed top, the second room having a fourth side, the second side facing the second room which is located between the first and third rooms, the third room is a round hole, a diameter of the third room being smaller than that of the second room, the third room sharing a common axis with the third side, an end face formed around a top of the second portion;

a ratchet wheel pivotably located in the first hole and the first room, the ratchet wheel having a toothed portion defined in an outer periphery thereof, the ratchet wheel having an engaging recess defined in a center thereof, a disk connected to a top of the ratchet wheel, a periphery of the disk protruding outward radially from the top of the ratchet wheel, the disk contacting the end face of the second body, the ratchet wheel having a second groove which is located corresponding to the first groove;

a pawl located in the second room of the second body and being movable within the second room, a top of the pawl being restricted by the fourth side of the second body, a bottom of the pawl being restricted by the closed bottom of the first body, the pawl having engaging teeth defined in a front side thereof, the engaging teeth engaged with the toothed portion of the ratchet wheel;

a switch unit pivotably connected to the third room of the second body and controlling movement of the pawl in the second room;

the switch unit having a switch member, a cap and a spring, the switch member being pivotably connected to the third room, an underside of the switch member contacting the closed bottom of the first body, a lever connected to a top of the switch member and exposed beyond the second body, the lever contacting the end face, the switch unit having a reception recess which faces the pawl, the cap and the spring located in the reception recess, the cap being biased by the spring to contact a rear side of the pawl so as to push the pawl to engage the engaging teeth with the toothed portion of the ratchet wheel, the cap contacting the fourth side of the second body to prevent the switch unit from disengaging from the third room, and a clip engaged with the first and second grooves to restrict the ratchet wheel within the first hole and the first room, the disk contacting the end face to connect the second body to the first body.

2. The ratchet wrench as claimed in claim 1, wherein the first body is made of Aluminum, Magnesium, alloy, plastic or carbon fibers.

3. The ratchet wrench as claimed in claim 1, wherein the second body is made of steel, iron or alloy.

4. The ratchet wrench as claimed in claim 1, wherein the engaging recess is a polygonal recess and is a through passage or a recess with a closed end, or the engaging recess is a rectangular head.

5. The ratchet wrench as claimed in claim 1, wherein the reception recess is a recess with a closed end.

6. The ratchet wrench as claimed in claim 1, wherein the clip is a C-shaped clip.

7. The ratchet wrench as claimed in claim 1, wherein a passage is defined in the ratchet wheel and located close to the second groove, the passage communicates with the second groove and the engaging recess, the clip has a contact end which is located in the passage and protrudes into the engaging recess.

8. The ratchet wrench as claimed in claim 1, wherein the first recess and the second recess of the first body have the same shape and size, and no shoulder is formed, the first and second portions have the same shape and size.

9. The ratchet wrench as claimed in claim 1, wherein the first body has a connection recess and a threaded recess, the connection recess defined through the first body and shares a common axis with the third room, the threaded recess is located at a lower end of the connection recess, the switch member has an insertion which is pivotably connected to the connection recess, a distal end of the insertion is threadedly connected to the threaded recess, a nut is connected to the distal end of the insertion, the switch unit is pivotably connected to the third room of the second body.

10. The ratchet wrench as claimed in claim 1, wherein the first groove is located at a lower portion of the first hole, the second groove is located at a lower portion of the toothed portion of the ratchet wheel, the clip protrudes beyond the first body.

* * * * *